US007306515B1

(12) United States Patent
Crenshaw et al.

(10) Patent No.: US 7,306,515 B1
(45) Date of Patent: Dec. 11, 2007

(54) MOVIE-RELATED CARD GAME

(76) Inventors: Michael D. Crenshaw, 3 W. Main St., Studio #5, Lansdale, PA (US) 19446; Christopher F. Lauria, 345 Kings Croft, Cherry Hill, NJ (US) 08034; Thomas P. Lauria, 506 W. Tuskeena St., Wetumpka, AL (US) 36092; Colin P. Merlo, 414 Kings Croft, Cherry Hill, NJ (US) 08034; Thomas J. Gilliano, 524 Wyoming Ave., Audubon, NJ (US) 08106

( * ) Notice: Subject to any disclaimer, the term of this patent is extended or adjusted under 35 U.S.C. 154(b) by 812 days.

(21) Appl. No.: 10/270,621

(22) Filed: Oct. 16, 2002

Related U.S. Application Data

(60) Provisional application No. 60/330,434, filed on Oct. 22, 2001.

(51) Int. Cl.
*A63F 13/00* (2006.01)

(52) U.S. Cl. ..... 463/11; 463/10

(58) Field of Classification Search ..... 463/40, 463/41, 42, 43, 11, 1; 273/305, 459, 269, 273/292, 93, 249
See application file for complete search history.

(56) References Cited

U.S. PATENT DOCUMENTS

| | | | | |
|---|---|---|---|---|
| 4,776,593 A | 10/1988 | DiPersio et al. | ..... | 273/93 |
| 4,846,480 A | 7/1989 | Oliver | ..... | 273/292 |
| 5,005,840 A | 4/1991 | Schwartz | ..... | 273/269 |
| 5,066,016 A | 11/1991 | O'Neill | ..... | 273/249 |
| 5,121,928 A | 6/1992 | Salerno-Sonneberg | ..... | 273/243 |
| 5,549,301 A | 8/1996 | Gerrard | ..... | 273/305 |
| 5,662,332 A * | 9/1997 | Garfield | ..... | 273/308 |
| 5,690,340 A | 11/1997 | Musleh | ..... | 273/459 |
| 5,944,313 A | 8/1999 | Hockley | ..... | 273/249 |
| 6,200,216 B1 * | 3/2001 | Peppel | ..... | 463/1 |
| 6,554,702 B2 * | 4/2003 | Mahar et al. | ..... | 463/11 |

OTHER PUBLICATIONS

MATTEL: "Monday Night Football Interactive TV Card Game"; 1998.*
Wikipedia, Uno Card Game, http://en.wikipedia.org/wiki/Uno_card_game.*
MATTEL; "Monday Night Football Interactive TV Card Game";Printed instructions and playing cards;1998.

* cited by examiner

*Primary Examiner*—John M. Hotaling, II
*Assistant Examiner*—Dat Nguyen

(57) ABSTRACT

A competitive interactive video game for a group of players includes a plurality of game elements, preferably playing cards, which comprise four different types of cards distributed to a group of players. The cards include cliche cards, attach cliche cards, pause cards, and rewind cards. The cliche cards each contain a written description and a point value while the attach cliche cards cancel the previous play of a cliche card by another player. The game further includes a means for providing a video presentation containing scenes which match the written descriptions on the cliche cards and which is viewed by the players. As the video presentation is viewed and the scenes matching the written descriptions on the cliche cards are recognized by the players, the players play their cards according to the rules of play and points are awarded to the players according to the point value on the cards. At the end of the video presentation, the winner is determined by the player who has accumulated the highest point total. Playing the pause card or rewind cards during the play can either temporarily stop the video presentation or cause it to be repeated according to the rules of play.

15 Claims, 9 Drawing Sheets

MOVIE-RELATED CARD GAME

The present application is related to provisional patent application Ser. No. 60/330,434 entitled "Movie-Related Card Game" filed on Oct. 22, 2001, priority from which is hereby claimed.

FIELD OF THE INVENTION

The present invention pertains generally to a specialized card game that combines chance, strategy, and a unique ability to interact with any method of viewable media, such as broadcast television shows or movies, movies recorded on viewable media like DVD, VHS, VCD, Betamax, Laser Disc, video disc, the Internet, electronic computer networks, and the like. The card game utilizes specialized card sets, a method of playing the game, as well as alternative embodiments of the same, including different game formats such as electronic games, interactive networks, computer software, and board games.

BACKGROUND OF THE INVENTION

Playing cards, such as the well-known fifty-two deck face cards, are easily and readily available. The cards themselves, individually and collectively, usually have no value other than for amusement. Many different games can be played with a single deck of playing cards, limited by the imagination of the players. Some card games require cards especially printed for that game, and these cards have little value outside the playing of that particular game.

Many games played with common face cards are games of chance. They have rules that require either the random selection of cards, or depend on the occurrence of events outside the control of the players. Other games that require some strategy are usually limited by restrictive rules of play.

At the present, there are no known games that use specialized playing cards in a themed card set that enable a player to interact with a video media format and create a unique combination of components that competes against the combinations of other players.

This invention will allow a group of two or more players to play a strategic card game while viewing a video media presentation of the players' choice. The video media presentation will dictate the play and flow of the game, while certain cards will enhance the strategy aspect and outcome of the game.

SUMMARY OF THE INVENTION

In one form, the present invention is directed to a game for two or more players. The game elements include rules of play and a plurality of game elements. The game elements comprise hand-holdable cards and the availability of a video media presentation of the players' choice. The game can also include articles or a method for tracking bonus points assessed by each player.

In accordance with another aspect of the present invention, the game elements comprise one or more state-altering elements that enable a player to alter the state of the game elements, the rules of play, and any player's point gain. State-altering effects include modifying the effect of other game elements and rules, and also reducing a player's point value, requiring elimination of other game elements, and suspension of one or more rules of play.

In accordance with another embodiment of the present invention, the game includes rules of play and game elements in the form of hand-holdable cards that comprise Cliché Cards having one or more clichés associated therewith, Cliché Cards that cancel other Cliché Cards, Pause Cards, and Rewind Cards.

In accordance with a further aspect of the present invention, the cards have a playing face with indicia thereon indicating what the card can do if played in the game. In addition, the cards may be comprised of a plurality of different types of cards, with the type of card being indicated by indicia thereon. The indicia may include symbols, words, numbers, artwork, or a color scheme.

In accordance with another aspect of the present invention, the game includes electronic devices for visually displaying the game elements and for enabling players to manipulate the game elements during play. Ideally, the electronic devices include communication devices to enable each player to communicate with other players.

In accordance with a further aspect of the present invention, a game is provided for two or more players that comprises a means to gain points; means that enable a player to cancel other players' points; means for enabling a player to pause the video media presentation for further interaction and game play; rule means for conducting the course of play; and means for enabling a player to alter the rule means.

In accordance with another aspect of the present invention, a game is provided for one or more players that comprises rules of play; a plurality of hand-holdable cards, each of the cards having a playing face, the cards further comprising Cliché Cards that provide points, Cliché Cards that enable a player to cancel an opponent's points, Pause Cards that temporarily stop the video media presentation for interactive game play, and Rewind Cards that enable a player to gain points.

The present invention is also directed to a method of playing a game wherein the game elements comprise a form of a video media presentation which is chosen by the players, viewed by all players, and dictates the means to play certain game elements. The players have free will to choose what video media presentation to view, and what format it will be presented in.

In accordance with another aspect of the present invention, the game is executed using two phases of play, a movie phase and pause phase, both which dictate what game elements may be played by all players.

In accordance with further embodiments of the present invention, a method of playing a game for two or more players is provided, the game components comprising rules of play, game elements including cliche elements, attack cliche elements, pause elements, and rewind elements, and a video presentation which includes scenes described on the cliche cards. The play begins with an opening hand of a pre-determined number of randomly selected elements from the reservoir of elements, and continues with playing the game elements to enable players to gain points. In one embodiment, the game is competitive and a winner is determined by maximum number of points of the cards played by each player.

As will be appreciated by the foregoing, the present invention provides a game that can be played in many game formats including hand-holdable cards, electronic games, computer software, interactive networks, board games, and the like. The game is typically fast paced and requires a high level of strategy, yet is adaptable to permit players of all levels of skill and ability to participate. The game gives a player the unique ability to modify the effect of other cards as well as the fundamental rules of play, and it further gives the player the ability to resist such ability on the part of opposing players, thus pitting players against each other in a battle of strategic skills and observation skills. The game further includes the unique feature of only being playable while all players view a video media presentation. In other words, the outcome of the viewed video media presentation will dictate the outcome of the game. Furthermore, the game is produced in themed card sets, such as the genres of horror, science fiction, action/adventure, romantic comedy, children/cartoon, and martial arts video media presentations, which permit players to choose their favorite video media genre and play the game along with the presentation.

More specifically, the applicants have invented a competitive interactive video game for a group of players comprising a plurality of game elements, such as hand-holdable playing cards or video displayed graphics, distributed to each of a group of players. The game elements comprise at least four types: cliche elements which each contain a different written description and a point value; attach cliche elements that cancel the cliche elements of other players; pause elements; and rewind elements. The game has a video means for providing a media presentation, such as a motion picture or television show, containing scenes which match the written descriptions on the cliche elements and which is viewed by the players. Rules of play are included by which game elements are played in response to the video presentation and in turn which is regulated by the play of the game elements thus creating the interactive nature of the game. The player with the highest accumulated point total at the conclusion of the game which ends after the video presentation is the winner. During a movie phase, cliche elements are played as players identify scenes from the video presentation that correspond to the written descriptions on cliche cards they hold. The video presentation may be temporarily stopped by playing the pause card and thereby beginning a pause phase of the game. During the pause phase, players may exchange their playing cards for different cards drawn from the reservoir of playing cards. A portion of the video presentation may also be repeated in response to playing a rewind card. According to the rules of play, players may gain points by the play of the game elements and acquiring bonus points.

In one embodiment of the invention, a reservoir of at least 150 playing cards is used. The cards are themed cards from among the group of horror, science fiction, action/adventure, romantic comedy, children/cartoon, or martial arts. Each card includes a text box which explains the use and effect of the card when played according to the rules of play. The cards also include bonus point indicia. During the play of the game, the cards are placed according to the rules of play into either an active area or a discard pile.

The foregoing and other features and advantages of the present invention will become more readily appreciated as the same becomes better understood by reference to the following detailed description when taken into conjunction with the accompanying drawings.

DESCRIPTION OF THE PREFERRED EMBODIMENT

Figure 1A:
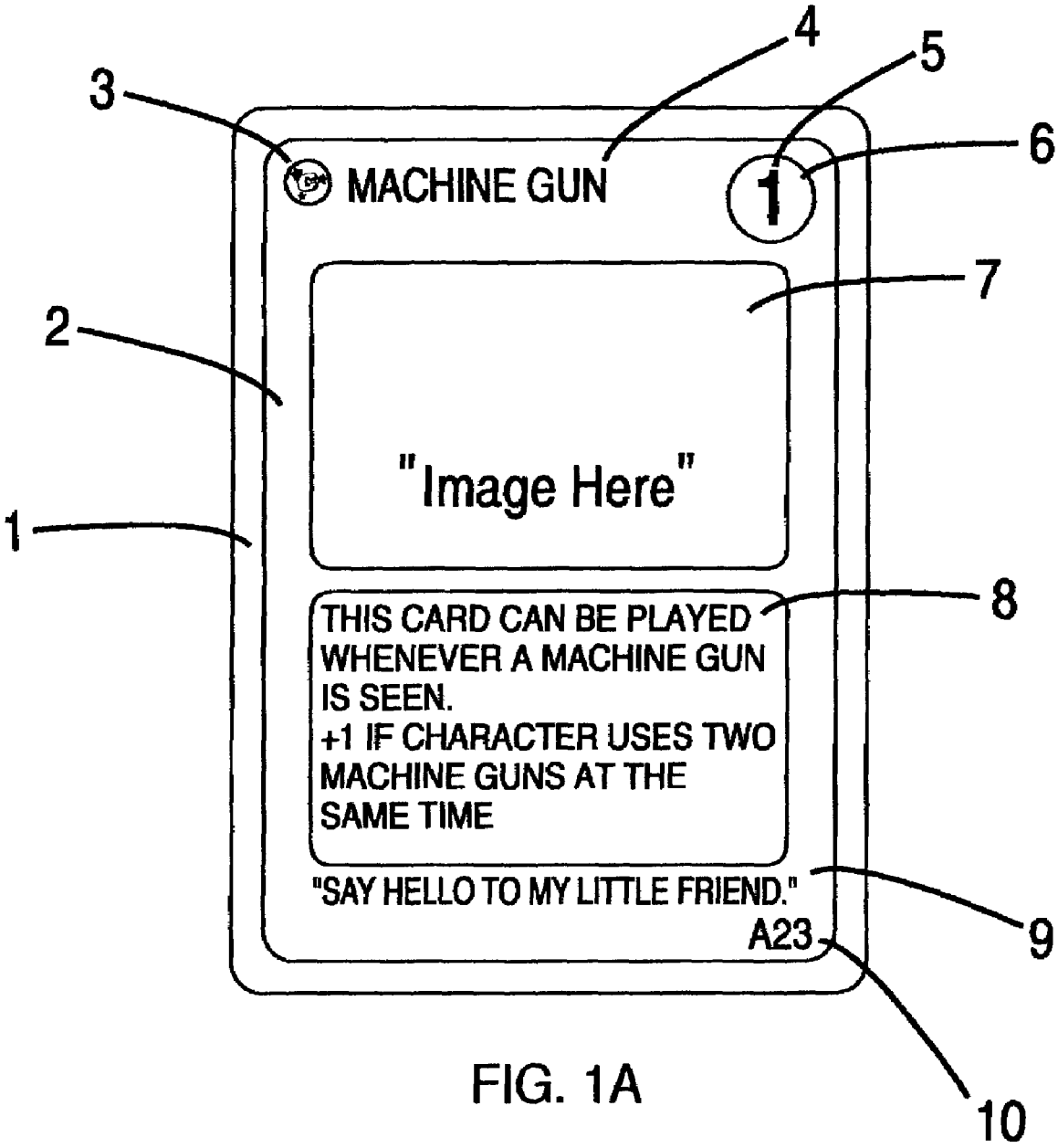
FIGS. 1A and 1B are plan views of the playing face of the playing cards formed in accordance with the present invention representing Cliche Cards.

The present invention pertains to an interactive game for two or more players wherein the players engage in a competition against each other in an attempt to gain more points than the other player. Each player utilizes a variety of cards that enable a player to gain points, alter the state of opposing players' points, and to modify the rules of play, including the effect of other players' cards, which involves careful strategy. The game must be played while all players view a type of video media presentation of their choice. The outcome of the video media presentation dictates which cards may be played and utilized by the players. Thus, the present invention is directed to not only the game elements, but also the method of playing the game along with a type of video media presentation.

In one embodiment of the invention, each player has access to a reservoir of playing cards. The reservoir is comprised of multiple copies of unique, individual game elements. However, some unique game elements have fewer copies than other unique game elements. Prior to engaging other players in gaining points, each player forms a hand of game elements by drawing game elements from the reservoir of elements. Each player pits his hand of game elements against the hand of game elements of every other player. Hence, strategy is required in trying to best utilize the hand of game elements each player has drawn to achieve maximum points based on the availability of game elements and the number of events (clichés) occurring in the video media presentation. In a typical game, players play game elements from their hand as events occur in the video media presentation, or against other players.

It is to be understood that the game elements can take different forms. For instance, in one version of the game, the elements are hand-holdable cards. In another version of the game, the players interact with each other via a computer network, with the game elements visually displayed on the monitor. Hence, the foregoing game is not to be limited to the embodiments described herein.

In one form, the game involves each player acquiring points by matching the events that occur during the play of the video media presentation to the game elements in their hand. Other game elements may alter the state of, or the effect of, the other elements, the rules of play, and any player. While the fundamental rules of play apply in multi-player and tournament games, modifications can be made as necessary to accommodate the needs of the game and the desires of the players.

In accordance with one embodiment of the invention, the game is played by two or more players in which cards represent clichés, cliché cards that cancel other cliché cards, and cards that manipulate the video media presentation, all at a player's disposal.

The game elements consist of cards having a playing face on one side. Ideally, the card reservoir (deck) will have at least 150 cards to ensure an appropriate mix of cards for enjoyable play, comprised of a plurality of Cliché Cards, Cliché Attack Cards, and Remote Cards. The effect of each of these cards, and the manner of playing them, is described more fully below. Each player gains points that are represented by the point totals on the cards and by bonus points. The bonus points can be accounted for by the use of counters such as pennies, poker chips, stones, or whatever is convenient. Bonus points can even be accounted for on paper, computer, or other available accounting means.

Figure 4:
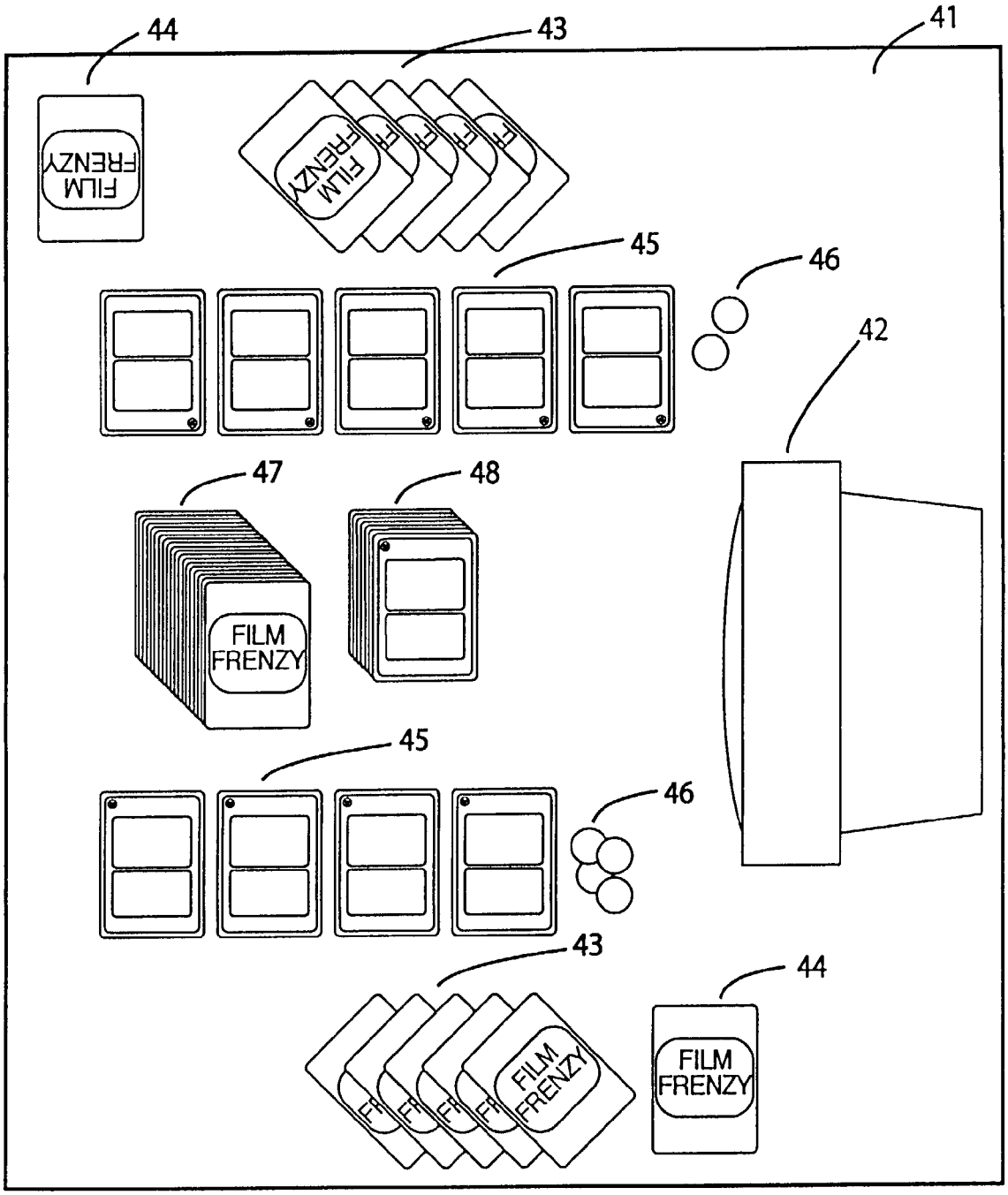
FIG. 4 is a diagram which depicts the layout of the playing surface for two players.

Referring initially to FIGS. 1A-2B with regard to the playing layout shown in FIG. 4, depicted therein are four types of cards available to the players. Other types of cards are, or may be, made available to players to further enhance the game. Each of the cards are preferably constructed of sturdy card stock and have a playing face on which is set forth illustrations and associated indicia about the effect of the card in the game. The opposite side of all the cards is the same and contains a standard design that, for example, may depict the name of the game and a business logo. This enables a player to keep the playing face concealed from opposing players until the card is entered into play.

Referring to the "Cliché Card" in FIG. 1A, the playing face has an outside border 1 and a background 2. Colors may be used in both the outside border and background to indicate what type of card it is and what it can do when used in play.

Figure 3:
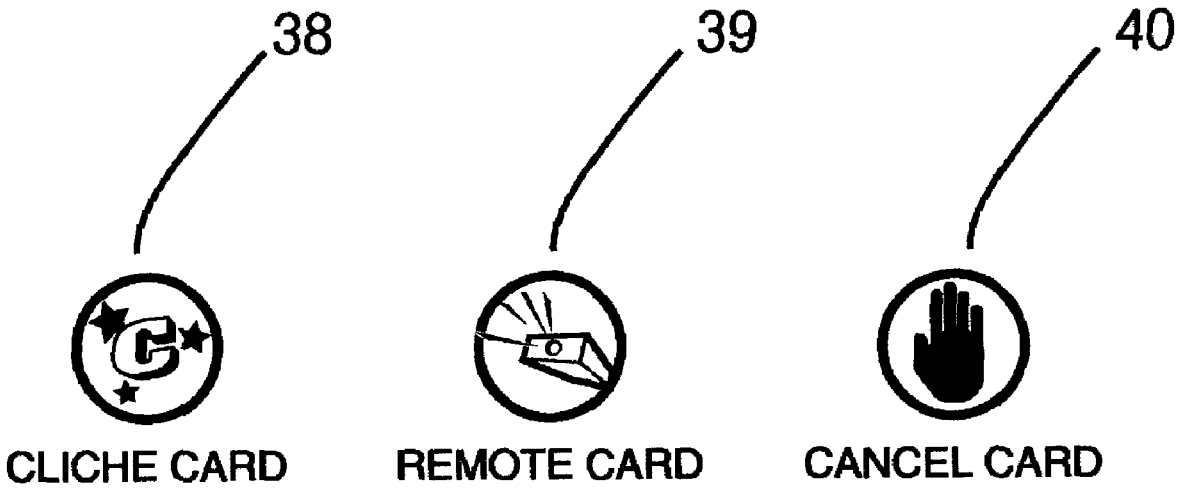
FIG. 3 is an enlarged plan view more clearly showing the icons depicted in FIGS. 1A, 1B, 2A, and 2B.

This particular Cliché Card (FIG. 1A) has a blue background 2 and enables a player to gain points 5 as actual clichés occur in the video media 42 presentation. Within the background color 2 on the playing face, in the upper left-hand corner, there appears an icon 3, which denotes the card type as well as when the card can be used in play (see FIG. 3 for full descriptions and drawings of all icons to be depicted in this version of the invention). The name 4 of the card is used to set the unique cards apart within a card type and help the player know when the card may be used in play. In the upper right-hand corner of the card is a circle 6 containing Arabic numerals 5 ranging from one to ten, indicating the point value of the card if it is still in a player's active area 45 by the end of the game. The circle 6 also contains a color to indicate that bonuses 46 may be gained as set forth in the text box 8. The illustration 7 provides a pictorial or graphic representation of the effect of the card. The illustration 7 is not necessary to the playing of the game and is provided more for the interest and enjoyment of the players. For instance, the illustrations can be used to provide a theme for the game, such as action/adventure, science fiction, war, horror, fantasy, romance, comedy, and the like. In the middle of the card is a text box 8, below the illustration 7. This text box is used to explain the use and effect of the card while in play, and on any special ability the card may have set forth by the color in circle 6, or in the outside border 1. In the lower left-hand corner of the card is a quote 9 that adds flavor and enjoyment to the card and is not necessary for play of the game. In the lower right hand corner is the card number 9 that is used in card sets to denote set origin and card reference.

A cliché is a stereotype, or overused scene or idea. Players are looking for clichés that occur in the video media 42 presentation that match the Cliché Cards in their hand 43. In order to play the Cliché Card (FIG. 1A), the cliché must occur in the video media 42 presentation and the card must be placed face up on the table 41 in that player's "active area" 45. Once a Cliché Card (FIG. 1A) is in play, it remains permanently in play unless another player's card cancels it, which causes it to be discarded into a "discard pile" 48 area. If the Cliché Card (FIG. 1A) has a colored circle 6 and has additional cliché references in the text box 8, then bonus points 46 may be granted to the player at the time of card play. All bonus points 46 remain with the player who earned them and are not transferred to the opponent's bonus points 46, if the Cliché Card (FIG. 1A) is canceled by means of an Cliché Attack Card (FIG. 1B).

Figure 1B:
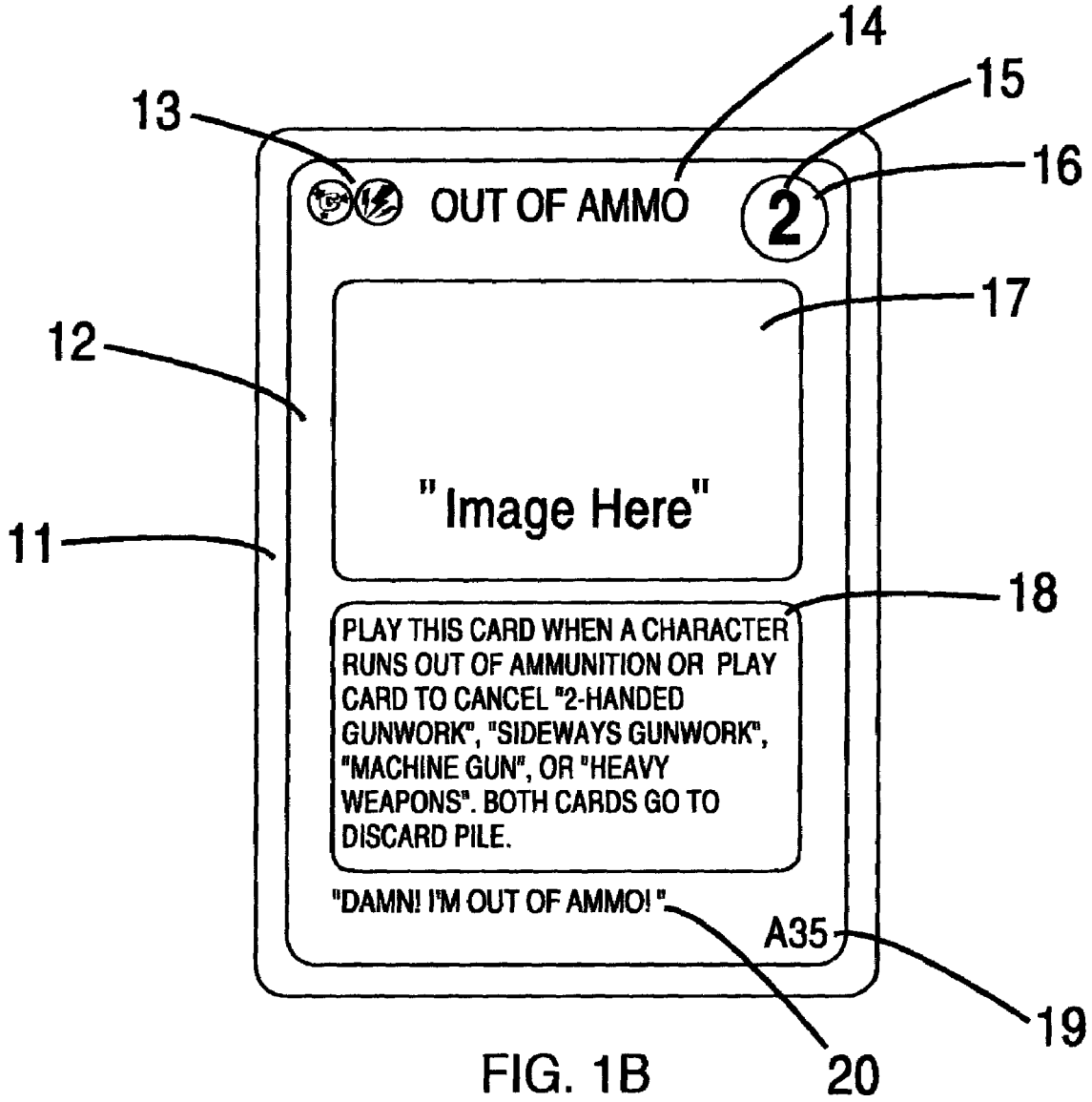

One special type of Cliché Card, depicted in FIG. 1B, has a blue background 13 with a yellow outside border 12. It enables a player to either gain points as the actual clichés occur in the video media presentation or cancel another player's Cliché Card (FIG. 1A) in play. This Cliché Attack Card (FIG. 1B) also has double icons 13. Cliché Attack Cards (FIG. 1B) with double icons 14 are the only cards that have the ability to be played as a Cliché Card or Cliché Attack Card. It has a non-colored circle 17 containing an Arabic numeral 16, indicating the point value of the card if it is used as a Cliché Card and is still in a player's "active area" 45 by the end of the game. If the card is used as a Cliché Attack Card as described in the text box 19, it gets sent to the "discard pile" 48 along with the opponents' canceled Cliché Card (FIG. 1A) from their "active area" 45. The effect of a Cliché Attack Card (FIG. 1B) will be explained more fully below.

Figure 2A:
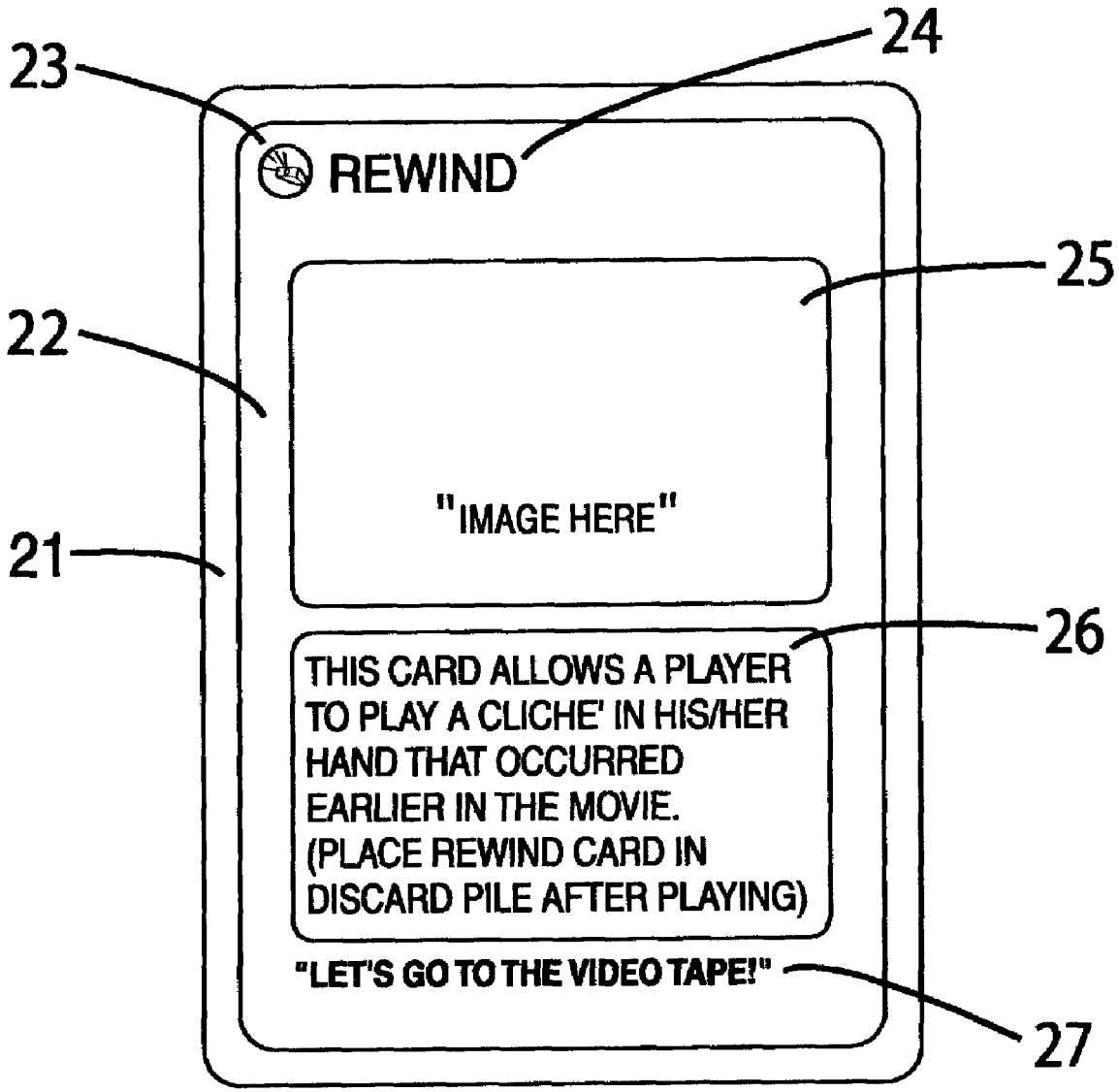
FIGS. 2A and 2B are plan views of the playing face of the playing cards representing Remote Cards.
Figure 2B:
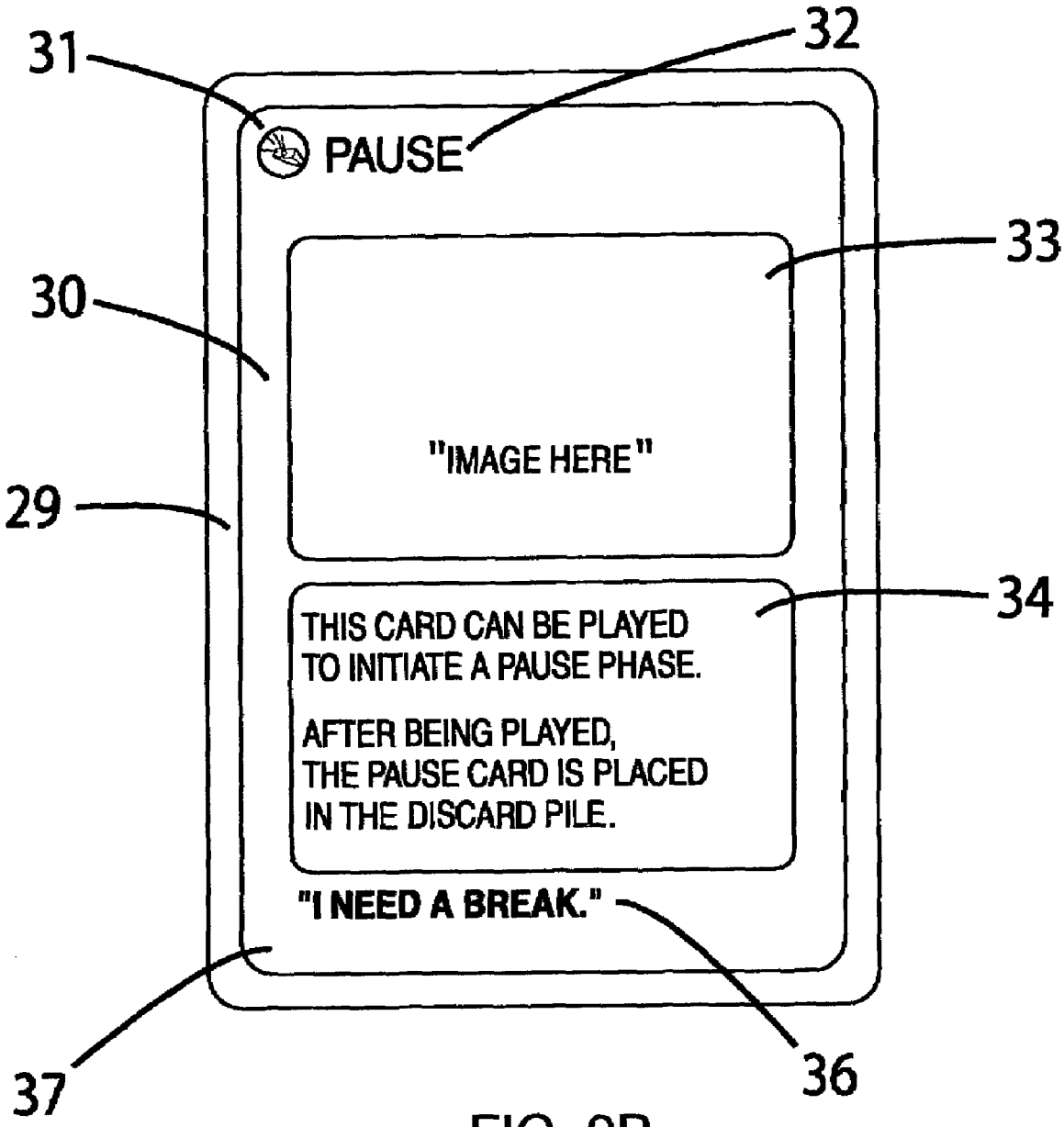

FIG. 2B depicts a Remote Card, named "Pause". It has a purple background 33 and a remote icon 34. The text in the text box 37 indicates the card can pause the video media 42 presentation being shown to the players, thus starting the "pause phase" of the game. This card, when played, does not go to the "discard pile" 48 but to an "out-of-play pile" (not shown) due to it not returning to active play. In the current embodiment of the invention, there are a finite number of times the Pause Card (FIG. 2B) will be played in a game due to there being ten cards named "Pause" in the card set, which only allows for ten pauses in a game.

FIG. 2A depicts a Remote Card named "Rewind". It has a purple background 24 a remote icon 25. The text in the text box 28 indicates that this Remote Card (FIG. 2B) allows the player to play a Cliché Card (FIG. 1A) that could have been played previously due to a cliché that occurred earlier in the video media 42 presentation being shown to the players. In this version of the game, this card also allows the player to use the video media's rewind feature to show his opponents the cliché that was viewed. This card, when played, does not go to the "discard pile" 48, but to the "out-of-play pile", due to it not returning to active play. In the current embodiment of the invention there are a finite number of times the Rewind Card (FIG. 2A) will be played in a game due to there being 15 cards named "Rewind" in the card set, which only allows for 15 rewind plays in a game.

FIG. 4 illustrates a representative playing surface divided into two areas for a game with two players. Each player will have an "active area" 45 where played Cliché Cards (FIG. 1A) will be placed face-up. Players will place their unused Pause Cards (FIG. 2B) 44 next to their "active areas" 45. In the center of the playing surface is where the card reservoir or draw deck 47 is placed, face-down. Discarded cards are placed face-up next to the draw deck known as the "discard pile" 48.

Play of the Game

Figure 5:
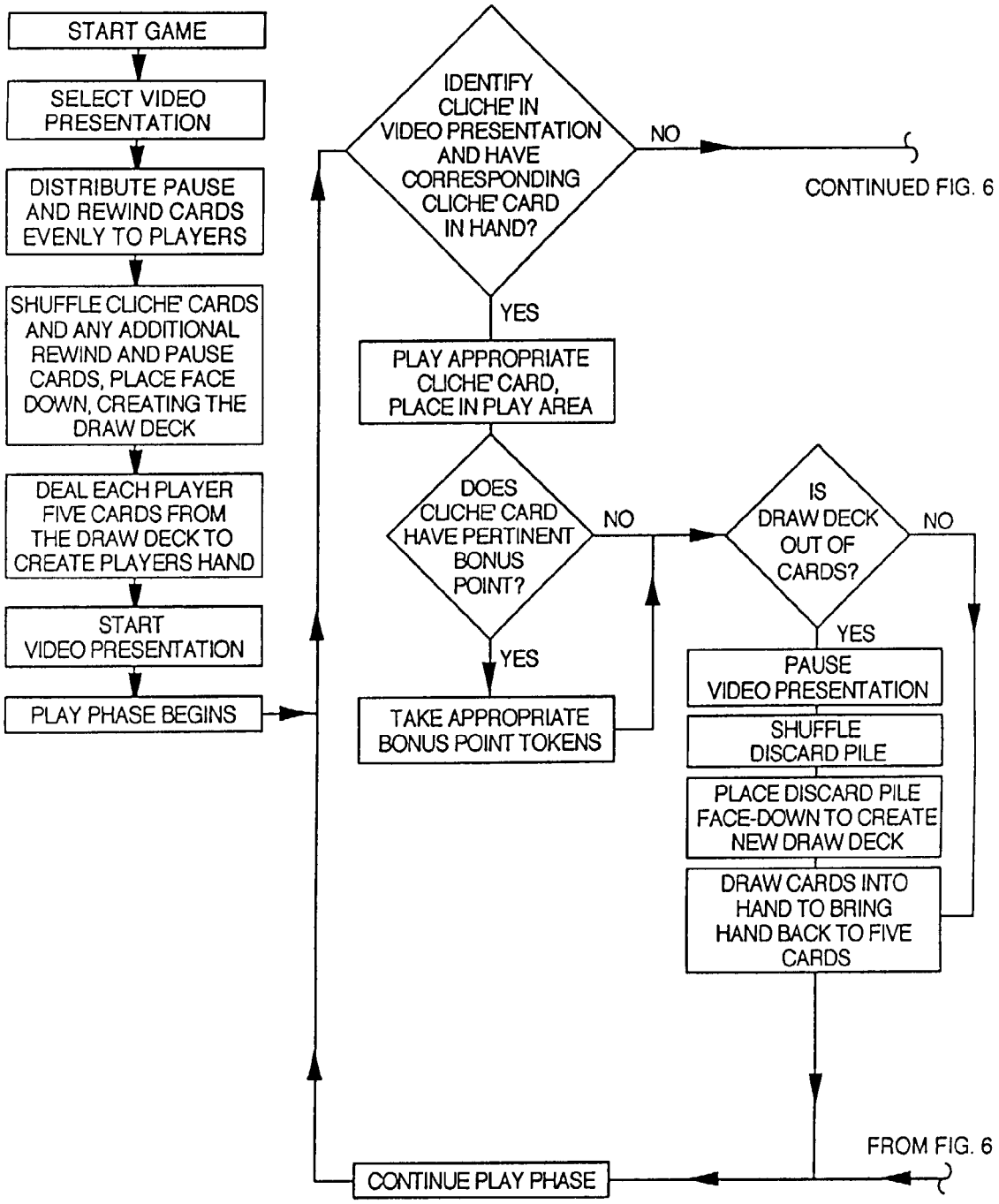
FIGS. 5-7 are flowcharts describing the play of the game.
Figure 6:
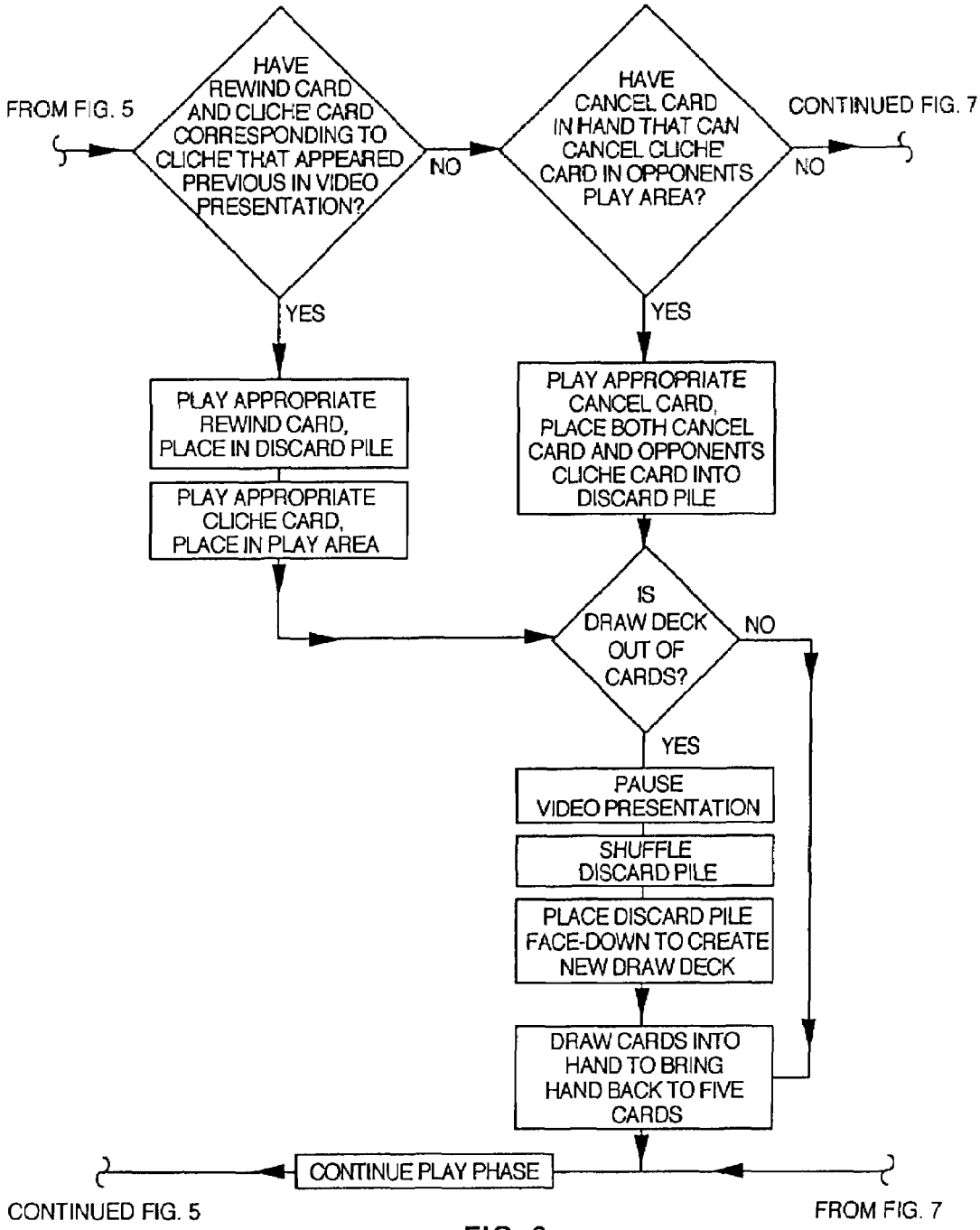
Figure 7:
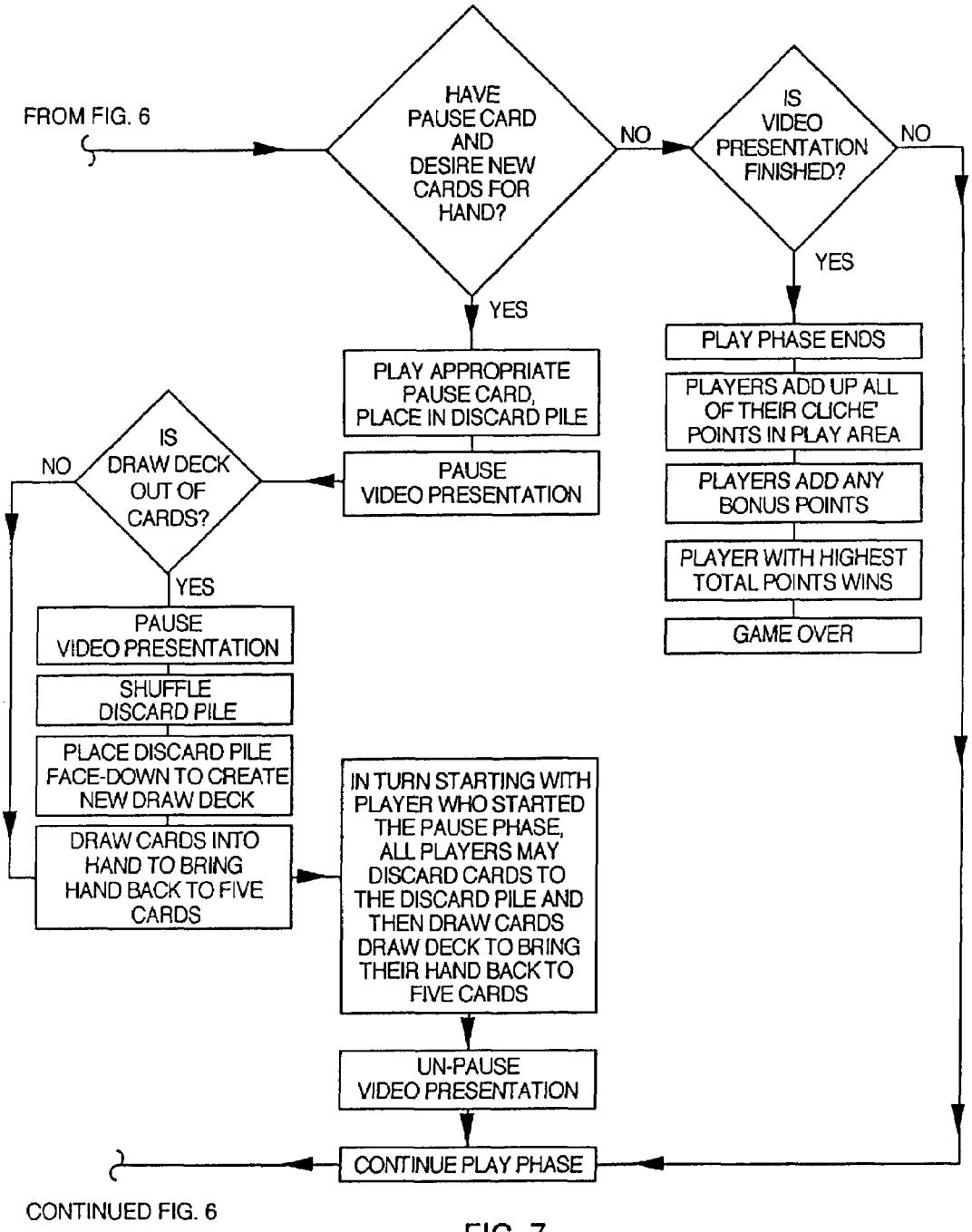

Following the above-described game elements, including the rules of play, FIG. 5 is a flow chart which illustrates the play of the game from beginning to end which will now be described in detail according to the preferred embodiment of the invention.

The game is generally played by each player obtaining an opening hand 43 of a predetermined number of randomly selected cards from the draw deck 47. All players share the draw deck 47. The draw deck 47 preferably consists of at least 150 cards to ensure an adequate mix of cards is present on which to draw on. The cards are placed face-down in the draw deck 47 after first being shuffled. In a preferred embodiment, players draw five cards. These cards remain in a player's hand 43 and are kept from view of other players until placed in the "active area" 45 and in play.

One embodiment of the invention includes limiting the number of Pause Cards (FIG. 2B) to only ten per game session. Before the game begins, the ten Pause Cards (FIG. 2B) are divided evenly among all the players. Any remaining Pause Cards (FIG. 2B) are shuffled into the draw deck 47. Thus, the video media 42 presentation may only be paused a possible total of ten times during one game session.

One embodiment of the invention includes limiting the number of Rewind Cards (FIG. 2A) to a maximum of only 15 per game session. Before the game begins, each player is given only three Rewind Cards (FIG. 2A) for play. Any remainders are placed in the "out-of-play pile". Thus, the video media 42 presentation may only be rewound a possible total of 15 times during one game session. If there are more than five players, before the game begins, the 15 Rewind Cards (FIG. 2A) are divided evenly among all the players. Any remainders are placed in the "out-of-play pile".

One embodiment of the invention includes the rule that all players' hand 43 of cards will always contain five cards. Thus, whenever a player plays or discards a Cliché Card from his hand 43, he immediately draws a new card from the draw deck 47 to keep his hand 43 always at five cards. This rule applies to both phases of the game, which are described below.

When a card is canceled or discarded, it is placed into the "discard pile" 48. If a card is countered as it is being played, it also goes into the "discard pile" 48 without having its effect. Occasionally, Remote Cards will be removed from the game entirely. In this case, it is set aside in the "out-of-play pile" until the next game.

One embodiment of the invention has two distinct phases of play: a Movie Phase and a Pause Phase. During both of these phases, players have an opportunity to use certain cards. Players play their cards by placing them onto the "active area" 45 at the appropriate moment during either of the two phases, which are described in detail below:

Movie Phase

The Movie Phase occurs when the video media 42 presentation is playing and being viewed by all the players. The only cards that can be played in the movie phase are Cliché Cards (FIG. 1A), Cliché Attack Cards (FIG. 1B), and Remote Cards (FIGS. 2A-2B).

When any player witnesses a cliché on the video media 42 presentation and has a matching Cliché Card (FIG. 1A) in his hand, he may bring that Cliché Card (FIG. 1A) into play. The player calls out the name of the Cliché Card (FIG. 1A) and then places it in his "active area" 45 on the playing table 41. As previously indicated, points are provided by Cliché Cards (FIG. 1A) that remain in the player's "active area" 45 until the end of the game. After playing a Cliché Card (FIG. 1A), the player then draws another card from the draw deck 47. Any number of players may play the same Cliché Card (FIG. 1A), if able, without penalty. At the end of the game, the point values of all Cliché Cards (FIG. 1A) in each player's "active area" 45 are totaled.

Some Cliché Cards (FIG. 1A) may provide a player the chance to gain "bonus points" 46 when the card is played. "Bonus point" indicia, if any, will be printed in the text-box 8 portion of the card and denoted by a colored circle 6 as in FIG. 1A. When a Cliché Card (FIG. 1A) with a "bonus point" is played and the "bonus point" applies to the cliché, the player receives a counter (coin, bead, etc.) to represent the "bonus point." "Bonus points" 46 may not be lost or stolen and they are added to the cliché point total for that player at the end of the game.

Certain Cliché Cards may provide a player with the ability to cancel an opponent's played Cliché Card (FIG. 1A). These are called Cliché Attack Cards (FIG. 1B). Specific "attack" indicia is denoted by an additional "attack" icon 14, the yellow border color 12, as well as being printed in the text-box 19 portion of the Cliché Attack Card (FIG. 1B). When a Cliché Attack Card (FIG. 1B) is used as an "attack" on an opponent's Cliché Card (FIG. 1A), both cards (the Cliché Attack Card and the Cliché Card being attacked) are placed face-up in the "discard pile" 48 and no points are awarded to either player. Each player discards the cards to the "discard pile" 48 and then draws back into his hand 43 the number of cards needed to bring the hand total back to five from the draw deck 47.

Rewind Cards (FIG. 2A) allow players to play Cliché Cards (FIG. 1A) that have already occurred in the video media 42 presentation. When a player uses a Rewind Card (FIG. 2A), he must state aloud that he is using the Rewind Card (FIG. 2A) and which Cliché Card (FIG. 1A) he is attempting to play. All players must agree that the cliché did occur earlier in the video media 42 presentation. If an agreement is made, that player's Cliché Card (FIG. 1A) is placed in his "active area" 45 and the Rewind Card (FIG. 2A) is placed in the "out-of-play pile". The Rewind Card (FIG. 2A) also gives the player the ability to substantiate his rewind claim by actually having the video media 42 presentation rewound, if necessary.

Pause Cards (FIG. 2B) may be played at any time during the Movie Phase to pause the video media 42 presentation and initiate the Pause Phase, which is described in detail below. To play a Pause Card (FIG. 2B), the player states aloud, "Pause", and places his Pause Card (FIG. 2B) in the "out-of-play pile", thus removing the card from that game session. Playing a Pause Card (FIG. 2B) is the only method in which the video media 42 presentation may be stopped. A Pause Card (FIG. 2B) may be played during the Pause Phase, to initiate an additional Pause Phase.

Pause Phase

The Pause Phase begins when a player successfully plays a Pause Card (FIG. 2B). During the Pause Phase, players have the opportunity to discard and draw cards, play Cliché Attack Cards (FIG. 1B), and play Rewind Cards (FIG. 2A).

The player who played the Pause Card (FIG. 2B) and paused the video media 42 presentation begins the Pause Phase by discarding and drawing cards if he wishes. New cards are drawn from the draw deck 47. Each other player gets an opportunity to draw from the draw deck 47 and discard cards to the "discard pile" 48, going clockwise from the player who paused the video media 42 presentation. To draw new cards, the player must discard at least one card into the "discard pile" 48. Once a player has discarded, the dealer will give that player enough cards to bring his hand 43 back to a total of five cards. If a player wishes, he may discard his entire hand at the beginning of his turn during the Pause Phase and the dealer will give that player five new cards from the draw deck 47.

Players have only one opportunity during each Pause Phase to discard and draw cards. If the cards from the draw deck 47 run out, the dealer re-shuffles the cards from the "discard pile" 48 and places them face-down to create a new draw deck 47. After all players have had a chance to discard and draw cards, they may then play Cliché Attack Cards (FIG. 1B), Rewind Cards (FIG. 2A), or additional Pause Cards (FIG. 2B).

Once all players have had the chance to discard and draw cards and they have played any other possible cards as described above, the Pause Phase ends and the video media 42 presentation resumes, thus starting a new Movie Phase. Play of the game continues with numerous Movie Phases and Pause Phases until the video media 42 presentation ends.

In summary, one method of playing the game comprises the steps of obtaining an opening hand 43 of a pre-determined number of cards from the draw deck 47, executing an action to enter into play Cliché Cards (FIG. 1A), and possibly canceling Cliché Cards (FIG. 1A) to thereby modify the effect of other Cliché Cards (FIG. 1A) to thereby gain points, or cause opposing players to lose points in the goal of defeating opposing players.

While the foregoing provides a description of one embodiment of the game elements and methods of play, various changes and enhancements may be made without departing from the spirit and scope of the invention. For instance, various cards may be added to the game that have additional features and are designed to be used with specific video media presentations made to reflect the cards in the associated deck. One example might be a morning cartoon program that has an associated card deck usable for children, where events in the program are recognized by the viewers and allow for the viewers to gain points by playing the associated card. This allows the program to be tailored to very specific viewing materials such as learning games, spelling and math problems, language lessons, or just entertainment.

It is also contemplated that the present invention can be used on existing and readily available electronic devices, such as computers, video games, electronic games, and on interactive networks utilizing computer software and text. Such electronic devices can visually display the cards and enable the players to manipulate the cards and execute the game rules as described herein above. Commercially available electronic communication devices can also be provided to enable players to communicate with each other over long distances.

Other changes and modifications may be made that still fall within the scope and spirit of the present invention. Hence, the spirit and scope of the invention is to be limited only by the scope of the claims that follow.

The invention claimed is:

1. A competitive interactive video game for a group of players, comprising:

a plurality of game elements distributed to each of a group of players, said game elements comprising at least four types: cliche elements which each contain a different written scene description and a given point value, attack cliche elements that cancel said cliche elements of other players, pause elements, and rewind elements;

video means for providing a media presentation showing scenes which match said written descriptions on said cliche elements and which is viewed by the players;

rules of play by which said game elements are played in response to a matching scene of said video presentation and said video presentation is regulated by the play of said game elements, said rules of play further including means for determining the winner and temporarily stopping the video presentation by playing one of said pause card and thereby beginning a pause phase of the game wherein said pause phase begins a time according to the rules of play during which players may exchange their playing cards for different cards drawn from a reservoir of playing cards; and wherein said play of said game elements includes playing a rewind card to replay a portion of the video presentation.

2. The game of claim 1 wherein said game elements are hand-holdable playing cards.

3. The game of claim 2 wherein said game ends at the end of said video presentation.

4. The game of claim 3 wherein according to the rules of play a winner is determined by the highest accumulated point total.

5. The game of claim 2 comprising a movie phase during which cliche elements are played as players identify scenes from the video presentation that correspond to the written descriptions on cliche cards they hold.

6. The game of claim 1 wherein said rules of play include means to gain points by the play of said game elements.

7. The game of claim 1 wherein said rules of play include means for acquiring bonus points.

8. The game of claim 1 wherein said game elements are video displayed graphics.

9. The game of claim 2 wherein said plurality of playing cards is a reservoir of at least 150 cards.

10. The game of claim 2 wherein said cards are themed cards from among the group of horror, science fiction, action/adventure, romantic comedy, children/cartoon, or martial arts.

11. The game of claim 2 wherein each card includes a text box which explains the use and effect of the card when played according to the rules of play.

12. The game of claim 2 wherein the cards include bonus point indicia.

13. The game of claims 1 or 2 wherein the video presentation is a motion picture.

14. The video presentation of claims 1 or 2 wherein the video presentation is a television show.

15. The game of claim 2 further including areas of play into which the playing cards are placed according to the rules of play: an active area and a discard pile.

* * * * *